US005222703A

United States Patent [19]

Ricciardelli

[11] Patent Number: 5,222,703

[45] Date of Patent: Jun. 29, 1993

[54] GOLF BAG SUPPORT

[76] Inventor: Nicholas Ricciardelli, 30 Hamilton St., Saugus, Mass. 01906

[21] Appl. No.: 870,248

[22] Filed: Apr. 17, 1992

[51] Int. Cl.[5] ..... A63B 55/00

[52] U.S. Cl. ..... 248/96; 248/532; 248/156

[58] Field of Search ..... 248/530, 96, 533, 156, 248/532, 346; 206/315.7, 315.3; 211/70.2

[56] References Cited

U.S. PATENT DOCUMENTS

| | | | |
|---|---|---|---|
| 1,537,598 | 5/1925 | Goldman | 248/346 |
| 1,811,296 | 6/1931 | Boden et al. | 248/96 |
| 1,826,216 | 10/1931 | Johnson | 248/96 |
| 1,849,803 | 3/1932 | Pedersen | 248/96 |
| 2,091,298 | 8/1937 | Agnew | 248/96 |
| 2,275,297 | 3/1942 | Hearnshaw | 248/96 |
| 2,496,792 | 2/1950 | Hellberg | 248/346 |
| 2,613,010 | 10/1952 | Atkinson | 248/156 |
| 2,970,630 | 2/1962 | Larsen et al. | 248/532 |
| 4,071,062 | 1/1978 | Ianetta | 248/96 X |
| 4,865,192 | 9/1989 | Williams | 206/315.7 |
| 4,942,962 | 7/1990 | Jordan | 248/156 X |

*Primary Examiner*—Alvin C. Chin-Shue
*Assistant Examiner*—Korie H. Chan
*Attorney, Agent, or Firm*—William Nitkin

[57] ABSTRACT

A golf bag stand having a spike member unit removably mounted on the bottom of the golf bag which spike member when in use is embedded in the ground to support the golf bag. The spike member unit when removed from the bottom of the golf bag is reversible and re-engageable to the bottom of the golf bag with the spike member safely positioned out of the way within a receipt aperture within the golf bag.

7 Claims, 3 Drawing Sheets

GOLF BAG SUPPORT

BACKGROUND OF THE INVENTION

1. Field of the Invention

The device of this invention resides in the area of golf bag support devices and more particularly relates to a golf bag support system having a spike protruding at the bottom of the golf bag which spike acts as a support stand when the spike is embedded in the ground with storage means for the spike when the device is not in use.

2. Description of the Prior Art

The prior art has several examples of golf bag support devices utilizing fixed or extending spike members from the bottom of such golf bags to function as stands. The following list is illustrative of the prior art:

| U.S. Pat. No. | Inventor |
|---|---|
| 1,291,359 | Babcock |
| 3,435,866 | Cantwell |
| 3,593,766 | Harmon et al |
| 3,666,221 | Schilz |
| 4,071,062 | Ianetta |
| 4,645,152 | Downing |
| 4,691,884 | Parduhn |
| 4,834,444 | Young |
| 4,942,962 | Jordan |

Typical of the patents disclosing extending spike elements is the Parduhn patent listed above which has a spike member as an accessory structure attached to the golf bag which spike member can be extended or retracted as desired. It is clearly understood in the prior art that spikes when embedded in the ground will conveniently support a bag but when the golf bag is being carried, the protruding spike represents a potential hazard as it can be struck against an object or individual. Further if the spike is left protruding during storage of the golf bag, such protruding spike would be not only inconvenient but also could be hazardous to nearby objects such as commonly found in the trunk of an automobile and the like. Therefore it is clearly desirable to have a golf bag spike which is retractable or removable in its storage mode and protruding in its use mode. The Ianetta patent listed above discloses a series of three spikes disposed at the bottom of a golf bag which spikes are removable during storage of the golf bag.

SUMMARY OF THE INVENTION

It is an object of this invention to provide an improved spike-type golf bag support which can be either an integral part of the plastic-formed base of the golf bag or an accessory device which can be attached to an existing golf bag.

It is a further object of this invention to provide a spike protruding from the bottom of the golf bag which can be quickly, easily and safely removed for convenient storage of same within the golf bag.

In one embodiment of this invention the golf bag can have a bottom specifically formed of plastic or equivalent material with the device of this invention integrally incorporated therein. In such case the molded plastic of the bag's bottom has a receipt aperture centrally defined therein and a series of keyways provided in a plane parallel to the bag's bottom disposed beneath the bottom of the golf bag. Within these keyways is rotatably inserted a base having a spike member thereon which base has laterally protruding members that are first inserted in areas between the keyways and then rotated so that the base's laterally protruding members engage into slots in the keyways, retaining the spike mounted on such base in its outwardly extending position for use to support the golf bag in an upright manner. When one desires to remove and store the spike, one rotates the spike base such that the laterally protruding members are no longer engaged within the keyways' slots. The spike with its base can then be removed from the golf bag base. The spike and its base can then be reversed with the spike slid into the central receipt aperture formed in the bottom of the golf bag. The protruding members being reversed are then laterally rotated to re-engage within the slots of the keyways at the bottom of the golf bag.

The structure of this invention can also be provided for use on existing golf bags by drilling a hole in the center of the bottom of the golf bag and in one embodiment, providing an inner plate which is placed inside the golf bag to be screwed onto an extension of a keyway unit place which extension passes through the drilled hole. Also such keyway unit place can be bolted on through the bottom of the golf bag or otherwise securely attached to the bottom of the golf bag bottom to provide an accessory structure virtually identical in function to one which is provided integrally as part of the bottom of a golf bag.

DESCRIPTION OF THE PREFERRED EMBODIMENT(S)

Figure 1:
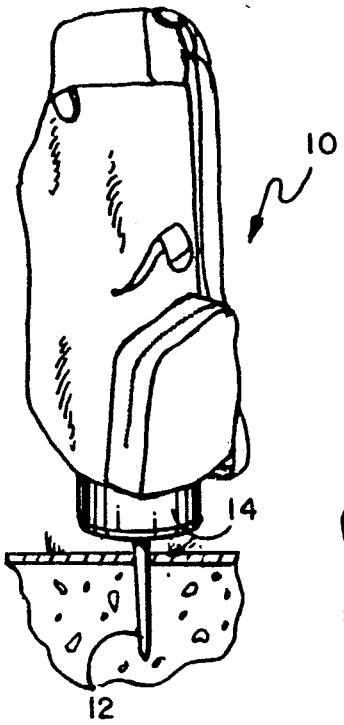
FIG. 1 illustrates a perspective view of a golf bag having the device of this invention incorporated within its base showing the spike embedded in the ground and supporting the golf bag in an upright position.

FIG. 1 illustrates a perspective view of the golf bag support of this invention on typical golf bag 10 to hold the golf bag in an upright position.

Figure 2:
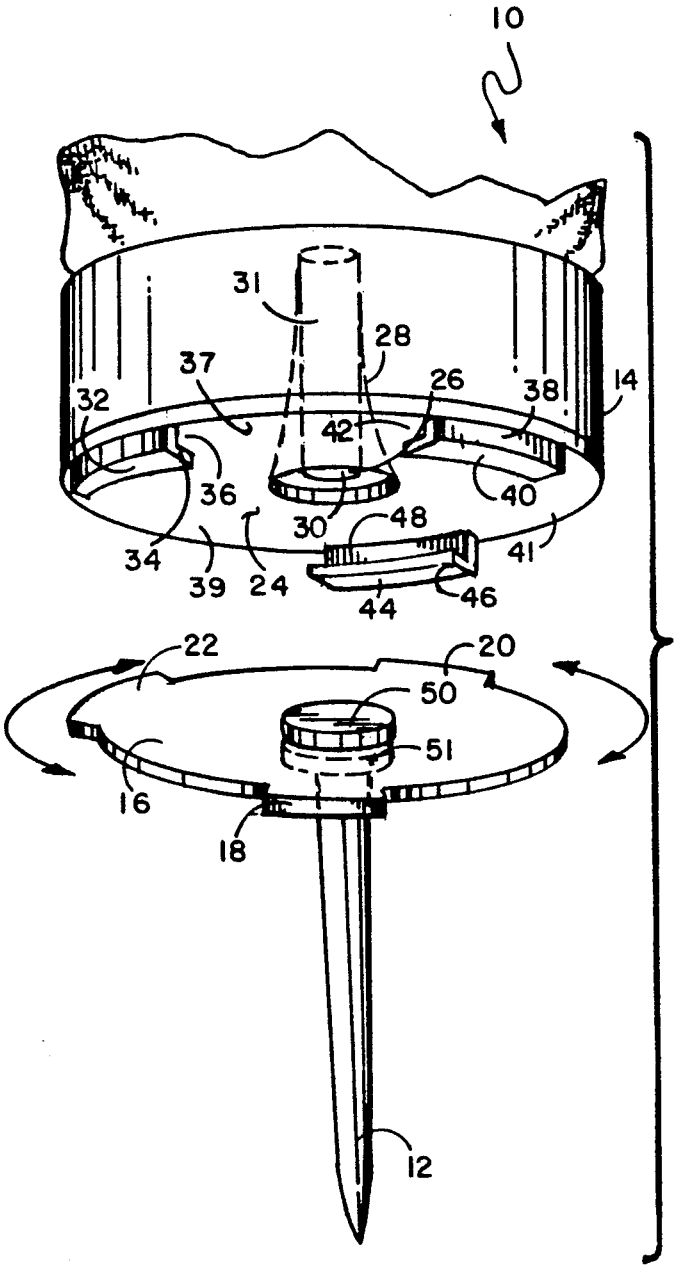
FIG. 2 illustrates a perspective view of the device of this invention showing the spike and its base aligned with, but separated from, the golf bag base/keyway structure of this invention.

In FIG. 2 the device of this invention is seen incorporated directly into the construction of golf bag base 14 of golf bag 10 which base in this version is round. It should be understood that although a golf bag having a round base is illustrated herein, the device of this invention can be incorporated as part of golf bags having non-circular shaped bottoms. Seen extending from base 14 of golf bag 10 is spike 12 which can be made of metal or sturdy plastic which spike is driven into the ground to support the golf bag in an upright position so that the golfer can retrieve and return golf clubs and other objects from the golf bag as desired. When it is desired to move the golf bag, the user merely lifts the golf bag straight up and the spike is disengaged from the ground, and the golf bag can be carried to its next position.

Figure 4:
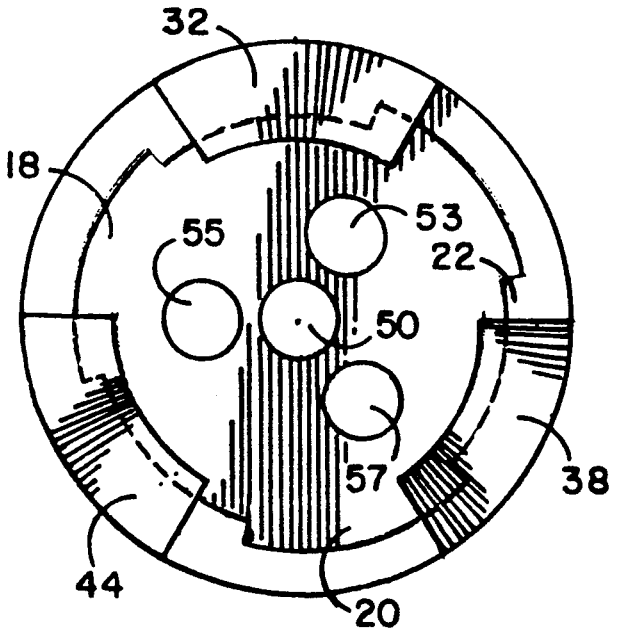
FIG. 4 illustrates a bottom view of the structure of FIG. 3 showing the spike inserted into the central receipt aperture in the golf bag base and the lateral protrusions of the spike base being re-engaged into the keyway slots to retain the spike member in its storage mode.

When it is desired to remove the spike for storage of the golf bag, spike base 16 which is generally planar and has a series of lateral protrusions 18, 20 and 22 extending from its periphery can be rotated so that lateral protrusions 18, 20 and 22 are disengaged from keyway slots 36, 42 and 48 in plate member 24 of golf bag base 14 and moved to open receipt areas 37, 39 and 41 between keyways 32, 38 and 44 such that spike base 16 is then free to be pulled away from golf bag base 14. Spike 12 can then be reversed and inserted into central receipt aperture 30 in golf bag 10, and the lateral protrusions 18, 20 and 22 then repositioned in open receipt areas 37, 39 and 41 between keyways 32, 38 and 44. Spike base 16 is then manually rotated using finger apertures 53, 55 and 57 seen in FIG. 4 or equivalent grasping means so that lateral protrusions 18, 20 and 22 then engage into keyway slots 36, 42 and 48. In this way spike base 16 is securely held, as seen in FIG. 4, onto base 14 of golf bag 10. Having spike 12 protrude within the golf bag presents no problem as it is relatively thin and narrow and will not damage any golf clubs because golf clubs inserted within the golf bag would glance by it even if they do strike it. In golf bags which have protective tubes for each individual golf club, the spike can be disposed between the exteriors of the tubes so that the spike is sealed off within the interior of the golf bag and no club can strike it. Also within the center of the golf bag can be disposed in one embodiment a spike projection protector 28, having a storage aperture 31 defined therein as seen in FIG. 2, positioned over the central receipt aperture, being conical in shape and of a length longer than the length of the spike. The spike projection protector will guide and retain the spike therein so that any dirt on the spike will not make contact with objects within the bottom of the golf bag. The spike projection protector can also be cylindrical in shape.

Figure 3:
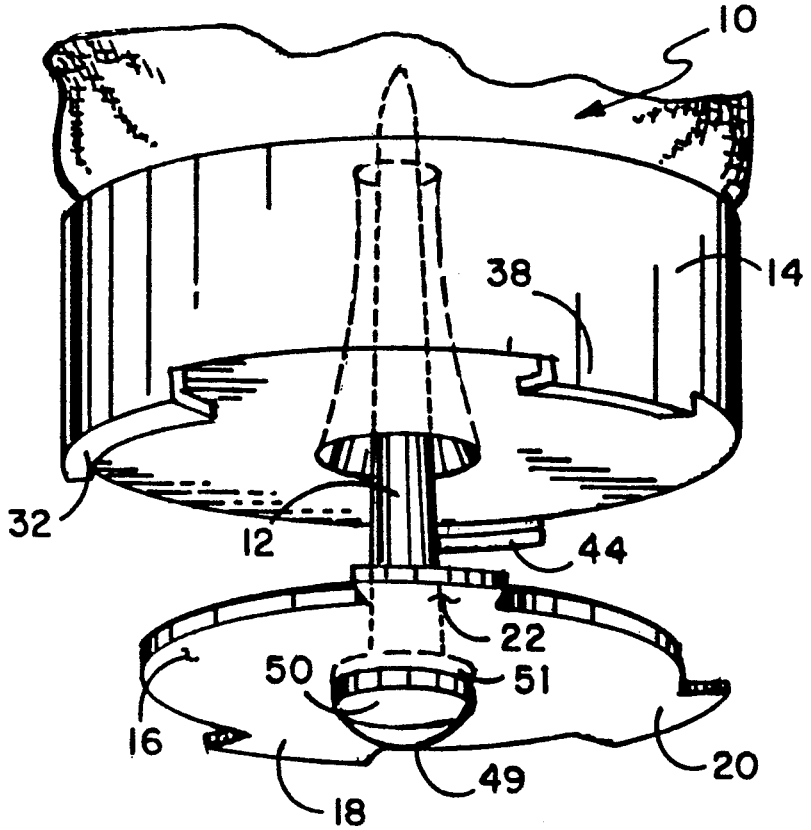
FIG. 3 illustrates a perspective view of the storage mode of the spike unit reversed with the spike being inserted into the central receipt aperture in the center of the golf bag base unit.

Seen in FIGS. 2 and 3 is spike 12 attached to its generally circular base 16 having three lateral protrusions 18, 20 and 22 extending concentrically out to a circumference adapted to fit within golf bag base 14 mounted on golf bag 10. A top projection 50 and bottom projection 51 disposed at the center of spike 16 on each side thereof, one around the spike and one in the same position on the other side of spike base 16, help align spike base 16 in a central receipt area 26 defined adjacent to central receipt aperture 30 for easy alignment of spike base 16 within the keyways as described below at golf bag base 14. On the bottom of golf bag base 14 are three keyways 32, 38 and 44 having open areas 37, 39 and 41 therebetween adapted to receive lateral protrusions 18, 20 and 22 of spike base 16 with the balance of spike base 16 adapted to fit in the area centrally located between keyways 32, 38 and 40. Within each keyway 32, 38 and 44 concentrically disposed around the bottom of golf bag base 14 are laterally disposed keyway slots 36, 42 and 48 which are of a size to receive snugly therein lateral protrusions 18, 20 and 22 when spike base 16 is placed with lateral protrusions 18, 20 and 22 in open areas 37, 39 and 41. One can then manually grasp spike base 16 using finger apertures 53, 55 and 57 seen in FIG. 4 and rotate spike base 16 so that lateral protrusions 18, 20 and 22 are moved into keyway slots 36, 42 and 48 which engagement retains spike base 16 in a position with either the spike aimed outward and top projection 50 positioned within central receipt area 26 or spike base 16 can be rotated, removed and reversed with spike 12 inserted into central receipt aperture 30 with lateral protrusions 18, 20 and 22 then rotated again into keyway slots 36, 42 and 48 and bottom projection 51 positioned within central receipt area 26. When the spike is aimed inside the golf bag as seen in FIG. 2, side member 28 of the spike projection protector can be angled so that golf clubs or other items placed in the golf bag can easily glance off the spike projection and not be damaged by the spike member's entrance therein. In a preferred embodiment, the spike can be approximately 7 inches in length. Also seen in FIG. 3 is wire catch 49 which can be attached to a recess formed in top projection 50 which wire catch is foldable into the recess when not in use and which wire catch can be easily grasped and pulled when one wishes to pull spike base 16 away from golf bag base 14.

Figure 5:
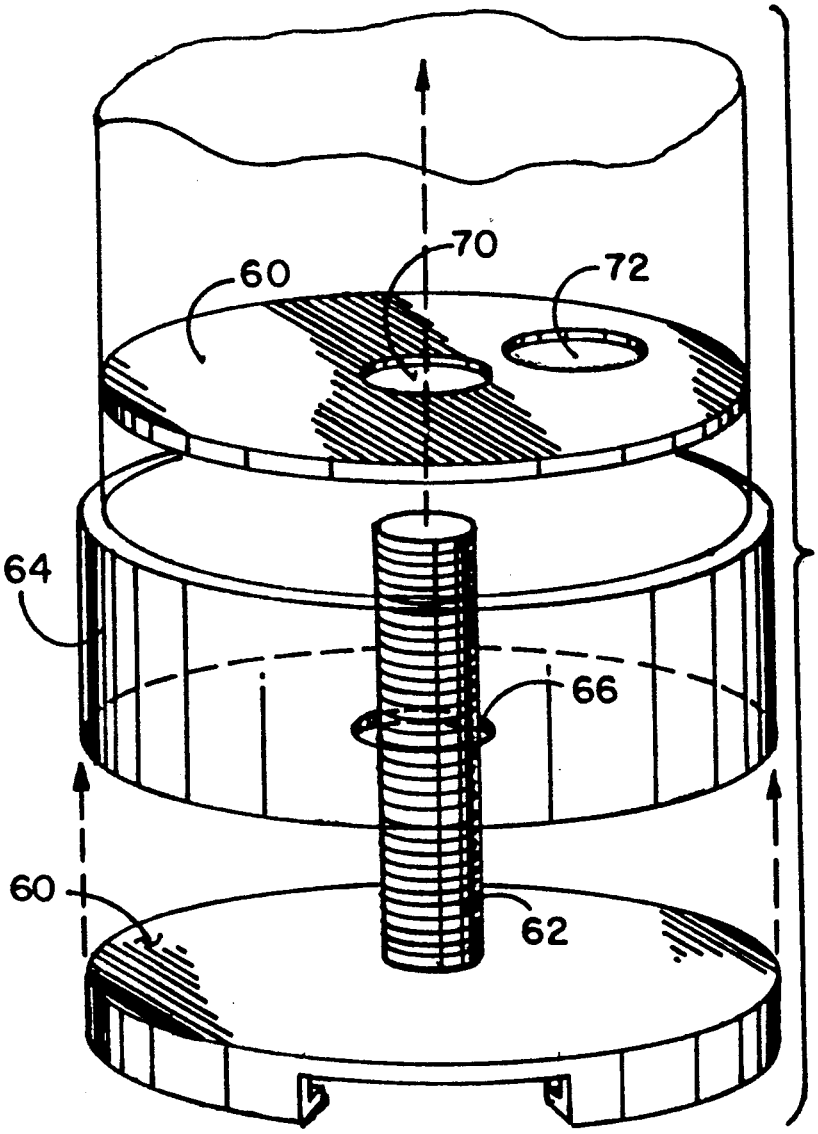
FIG. 5 illustrates a perspective view of the embodiment of this invention utilized as a golf bag accessory for installation on the bottom of an existing golf bag.

FIG. 5 illustrates one embodiment of attachment of the device of this invention as an accessory unit to the bottom of an existing golf bag. A central aperture 66 is drilled into the center of golf bag base 64. A keyway unit 60 having a hollow threaded projection 62 can have such threaded projection 62 passed through aperture 66 until keyway unit 60 contacts base unit 64. Retention plate 68 is then fitted within the golf bag and a threaded receipt aperture 70 in retention plate 68 is then passed onto threaded projection 66. Retention plate 68 is then rotated to screw it down on threaded projection 62 until it tightens keyway unit 60 onto the bottom of base unit 64. Aperture 72 can receive a shaft, not shown, to rotate retention plate 68 as it is screwed downward. Keyway unit 60 can also be attached to base unit 64 by other equivalent means such as screws and the like as long as such attachment means do not interfere with the engagement of the spike base, not shown, to keyway unit 60.

Although the present invention has been described with reference to particular embodiments, it will be apparent to those skilled in the art that variations and modifications can be substituted therefor without departing from the principles and spirit of the invention.

I claim:

1. A golf bag support device for use on the base of a golf bag comprising:

a plate member disposed at the bottom of said golf bag having a plurality of keyway slots arrayed in a circle defined therein, said slots having open receipt spaces defined therebetween;

a central receipt aperture defined in the center of said plate member;

a spike member;

a circular planar spike base having a diameter smaller than a diameter defined by said circle, said spike base having a top side and a bottom side, said spike base having said spike member mounted centrally on the top side thereon and projecting therefrom perpendicular to said spike base, said spike base having a plurality of lateral protrusions projecting therefrom, said protrusions having a circular periphery, said spike base is fitted between said keyway slots with said lateral protrusions adapted to be aligned within said keyway slots when said spike base is rotated to a lock position with said plate member whereby said lateral protrusions are engaged into said keyway slots for maintaining said spike member in a first use mode in an outwardly extending position; and when said spike base is rotated to a lock position whereby the lateral protrusions are disengaged from the keyway slots, said spike base is removed and reversed such that said spike member is inserted into said central receipt aperture with said spike base being re-engaged into said keyway slots in a second storage mode.

2. The device of claim 1 wherein said keyway slots open inwardly toward said central receipt aperture, said keyway slots being positioned concentrically around said central receipt aperture.

3. The device of claim 2 wherein said plate member is formed integrally as part of the bottom of said golf bag.

4. The device of claim 2 further including a conically shaped spike protection projector disposed inside said golf bag having a storage aperture defined therein communicating with said central receipt aperture.

5. The device of claim 3 further including a conically shaped spike protection projector disposed inside said golf bag having a storage aperture defined therein communicating with said central receipt aperture.

6. The device of claim 2 further including:

a first spike base central projection disposed around said spike; and a second spike base central projection positioned on the bottom side of said spike base in the center thereof.

7. The device of claim 6 wherein said spike base further includes at least one aperture defined therein to act as a finger receipt hole to use for ease in rotating said spike base when engaging said spike base in, and removing said spike base from, said keyway slots.

* * * * *